United States Patent [19]

Weitemeyer et al.

[11] 4,302,512

[45] Nov. 24, 1981

[54] PREPARATION FOR THE ABHESIVE COATING OF BAKING TINS, CAKE TINS, FRYING PANS, METAL POTS, AND THE LIKE

[75] Inventors: Christian Weitemeyer; Vaclav Kropac, both of Essen; Manfred Priesch, Recklinghausen, all of Fed. Rep. of Germany

[73] Assignee: Th. Goldschmidt AG, Essen, Fed. Rep. of Germany

[21] Appl. No.: 141,810

[22] Filed: Apr. 21, 1980

[30] Foreign Application Priority Data

Apr. 24, 1979 [GB] United Kingdom ..... 142216/79

[51] Int. Cl.[3] ..... B32B 9/04

[52] U.S. Cl. ..... 428/447; 427/387; 427/388.1; 427/388.2; 428/450; 528/20; 528/33

[58] Field of Search ..... 427/387, 135, 388.1, 427/388.2; 428/447, 450, 457; 426/811; 528/20, 33

[56] References Cited

U.S. PATENT DOCUMENTS

| | | | |
|---|---|---|---|
| 3,922,443 | 11/1975 | Brown et al. | 427/387 X |
| 3,925,276 | 12/1975 | Merrill | 260/18 S |
| 3,936,578 | 2/1976 | Dumoulin et al. | 427/387 X |
| 4,011,362 | 3/1977 | Stewart | 428/447 |
| 4,202,929 | 5/1980 | de Montigny et al. | 427/387 X |

*Primary Examiner*—Ralph S. Kendall
*Assistant Examiner*—Thurman K. Page
*Attorney, Agent, or Firm*—Toren, McGeady & Stanger

[57] ABSTRACT

A composition for the abhesive coating of metallic cooking surfaces composed of a heat-curable polysiloxane resin, based on the silicone resin, and 0.05 to 4 weight percent of a compound having the formula

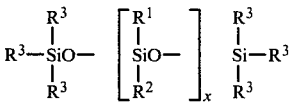

in which $R^1$ and $R^2$ are the same or different and represent a methyl or phenyl residue, with the proviso that at least 80 mole percent of these residues are methyl residues, $R^3$ are the same or different and represent a residue or several residues of the group (a) alkyl residues with 1 to 4 carbon atoms, (b) phenyl residues, (c) residues which are capable of reaction with the condensable groups of the curable polysiloxane resin, wherein at least one residue $R^3$ has the meaning of (c), x is 0 or a number greater than 0.

The composition forms coatings which are durably abhesive and possess excellent mechanical resistance under conditions of use.

19 Claims, No Drawings

PREPARATION FOR THE ABHESIVE COATING OF BAKING TINS, CAKE TINS, FRYING PANS, METAL POTS, AND THE LIKE

BACKGROUND OF THE INVENTION

1. Field of the Invention

The invention relates to a preparation for the abhesive coating of baking tins, cake tins, frying pans, metal pots and the like, which consists predominantly of heat-curable polysiloxane resins and may contain hardeners, pigments, fillers, cross-linking and spreading agents, as well as solvents.

2. Description of the Prior Art

It is well known that baking tins, cake tins, frying pans, metal pots and cooking utensils may be provided with a release coating in order to prevent baked or cooked foods, especially those containing sugar, adhering to or not separating from the surface of the metal.

Release agent coatings of polytetrafluoroethylene which are fused onto the surface of the tin and which mostly consist of aluminum or tin plate are known. These coatings however have several disadvantages. One serious disadvantage is that the fusion temperatures required for applying the polytetrafluoroethylene to the surface of the metal are so high that the metallurgical properties, especially of aluminum molds, are affected. It is a further disadvantage that the hardness of the coating is inadequate. This leads to mechanical damage to the polytetrafluoroethylene layer as the molds, tins, and the like are used and, as a result, the baked material once again commences to adhere. Organopolysiloxane resins have also already been recommended for the abhesive coating of tins which come into contact with sugar and sugar-containing foods.

U.S. Pat. No. 3,925,276 discloses the use of an organopolysiloxane resin with silanol groups, which is obtained in a special manner. Apart from a solution of this resin in xylene, the preparation for the coating additionally contains a viscosity-affecting solvent, iron octoate, as a hardener for the silicone resin, and slight amounts of a liquid methylphenylsiloxane. Since the silicone resin exhibits inadequate release action by itself, it may be assumed that the relatively good abhesive properties may be substantially attributed to the liquid siloxane, which has been added since it is only limitedly miscible with the resin and therefore accumulates at the surface. It is a disadvantage that, on repeated use, these silicone oil portions present in the surface are removed and the release action is diminished in the course of usage.

A release agent is described in German Offenlegungsschrift No. 27 00 038 which is based on the state of the art as defined by U.S. Pat. No. 3,925,276. The essential characteristic of this German Offenlegungsschrift is the fact that, in addition to silicone oil, about 10 to 40 weight percent of a fluorinated hydrocarbon polymer is added in a finely dispersed form to the previously described silicone resin. The particles of fluorinated hydrocarbon polymer are firmly tied into the matrix of the cured silicone resin so that, even after the removal of the silicone oil from the surface, a certain long-term effect is maintained. It is however a disadvantage of the added fluorinated hydrocarbon polymer particles that, especially at higher levels of addition, the mechanical properties of the coating are once again impaired.

SUMMARY OF THE INVENTION

We have discovered a preparation for the abhesive coating of baking tins, cake tins, frying pans, metal pots and the like, which is durably abhesive and adequately resistant mechanically under use conditions. In use, the preparation can be heated at temperatures as high as those at which the structure of aluminum or tin plate, for example, is not affected.

More particularly, the composition of the present invention consists predominantly of a silicone resin and contains 0.05 to 4 weight percent based on the silicone resin of a compound of the general formula

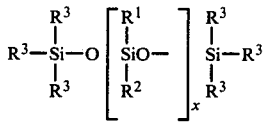

in which $R^1$, $R^2$ are the same or different and represent a methyl or phenyl residue, with the proviso that at least 80 mole percent of these residues are methyl residues, $R^3$ are the same or different and represent a residue or several residues of the group (a) alkyl residues with 1 to 4 carbon atoms, (b) phenyl residues, (c) residues which are capable of reaction with the condensable groups of the curable polysiloxane resin, wherein at least one residue $R^3$ has the meaning of (c), x is 0 or a number greater than 0.

The essential characteristic of the preparation of the present invention therefore consists of the addition of a special siliconorganic compound which is linear and has at least at one end, a reactive group and which is capable of reacting with the reactive groups of the hardenable polysiloxane resin. As a rule, the reactive groups of the hardenable silicone resin are SiOH groups or SiO-alkyl groups whose alkyl residue has 1 to 4 and especially 1 to 2 carbon atoms.

DESCRIPTION OF THE PREFERRED EMBODIMENT

Preferred reactive groups of the siliconorganic compound of the present invention are the Cl-, OH-, LiO- or $R^4O$-residue, wherein $R^4$ is an alkyl or acyl residue with 1 to 4 carbon atoms and preferably is the methyl or ethyl residue. The preferred acyl residue is acetyl.

The two residues $R^1$ and $R^2$ may be the same or different and represent the methyl or phenyl residues. They must correspond to the condition that at least 80 mole percent of these residues are methyl residues. Preferably, more than 90 mole percent of the residues are methyl residues.

The chain-limiting groups of the reactive polysiloxane are $R^3$-groups. At least one $R^3$-group has to be capable of reacting with the condensable groups of the curable polysiloxane resin. This may also apply to more than one $R^3$-group, for instance, two, three or all of the $R^3$-groups. However, it is sufficient if one $R^3$-group is capable of reacting with the condensable groups of the curable polysiloxane resin. Preferred are compounds which contain two or more of such reactive residues.

The remaining residues of the chain-limiting Si-atoms are alkyl residues with 1 to 4 carbon atoms and/or phenyl residues. Alkyl residues are preferred.

The index may be 0. Preferably, however, x has a value greater than 0, especially a value of 10 to 500 and preferably of 15 to 150.

Examples of such reactive polysiloxanes are:

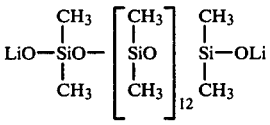

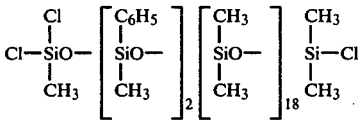

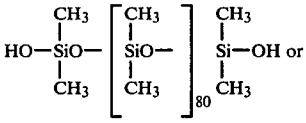

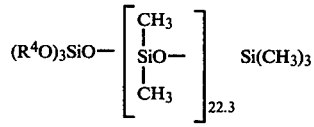

$R^4 = C_2H_5-$

The synthesis of these compounds with one or two reactive groups is known. An example of the synthetic process is the reaction of hexamethylcyclotrisiloxane with organolithium compounds or lithium silanolates (Adv. Polym. Science 28 (1978) 33).

Further possibilities are the reaction of a $\alpha,\omega$-dichloropolysiloxane with alcohols to $\alpha,\omega$-dialkoxypolysiloxanes (W. Noll, Chemie and Technologie der Silicone "Chemistry and Technology of Silicones," Verlag Chemie, Weinheim, 1968, page 71), or with acetic acid anhydride to $\alpha,\omega$-diacetoxypolysiloxanes (W. Noll, ibid, page 95).

Another process consists, for instance, of the reaction of $\alpha,\omega$-dihydroxypolysiloxanes with tetraethoxysilane and p-toluene sulfonic acid as catalyst.

The compounds contained in these preparations have the particular advantage that, although they are compatible and miscible with the silicone resins to only a limited extent, and are therefore concentrated in the surface of the resin, they are nevertheless tied into the structure of the silicone resin by means of the reactive group. This leads to the desired and required long-term effect of the abhesive coating.

In principle, all known heat-curable silicone resins may be used, provided they are capable of forming mechanically stable coatings which can cure at sufficiently low temperatures, and adhere to the metallic substrate. Suitable resins include those described in German Offenlegungsschriften Nos. 17 95 376, 20 05 762 and 27 00 038. It is, however, particularly advantageous to use as heat-curable silicone resins those resins which combine slight thermoplasticity with a low heating temperature. Particularly suitable as a heat-curable silicone resin are those obtained by reacting siloxanes of the general formula

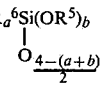

in which $OR^5$ is an alkoxy group of a primary or secondary aliphatic alcohol with 1 to 4 carbon atoms, $R^6$ is an alkyl and/or phenyl residue, a has a value of 1.0 to 1.5, b has a value of 0.1 to 0.7, with low molecular weight, multivalent alcohols, at temperatures of 100° to 160° C.

If necessary, the reaction may be carried out in the presence of known transesterification catalysts, and solvents in a ratio such that one $SiOR^5$ corresponds approximately to one COH group. The reaction may be stopped at a degree of conversion of 25 to 85%, by cooling to a temperature of less than 100° C.

A process for producing these silicone resins is described in German Offenlegungsschrift No. 28 28 990. These silicone resins have a high degree of thermal stability, elasticity, gloss stability and adhesion to the substrate. They cure at a high rate, are pigment-compatible to an unusually high extent and, on thermal treatment, show only very slight losses in weight. The cure of these resins may be accelerated in the usual manner by catalysts, such as, for example, butyl titanate, or iron or cobalt octoate. The resins may be cured at temperatures of 300° C. or less, especially in a temperature range of 200° C. to 270° C. to the desired coatings.

Trimethylolpropane is preferably used as the esterification component. The $R^6$ residue preferably consists of alkyl and phenyl residues with a preferred molar ratio of methyl to phenyl residues in the range from 0.5:1 to 4:1, and preferably, 2:1 to 3.5:1, which provides films which are particularly capable of withstanding mechanical stresses.

The preparation of the present invention contains the curable silicone resin as known to the state of the art dissolved in a solvent to which the silicone compound, which is to be added in accordance with the present invention, has been added in the amount stated.

Hardeners, such as, for example, butyl titanate or tin octoate, pigments or fillers, such as, for example, titanium oxide or carbon black, as well as cross-linking and flow promoting agents, such as, for example, lecithin or ethyl cellulose may be added in known amounts in a manner which, in itself, is known, to the preparation.

The preparations are sprayed, coated, painted or applied by dipping on the substrate to be coated and then heated, the heating temperature depending on the nature of the resin and on the catalyst which may have been added. A coating, approximately 10 to 40 micron thick is achieved in this manner.

The following examples described the present invention:

Four resins designated A, B, C and D were prepared by the following known procedures.

Resin A

An alkoxypolysiloxane is prepared from 80 mole percent of phenyltrichlorosilane, 15 mole percent of dimethyldichlorosilane and 5 mole percent of trimethylchlorosilane by cohydrolysis using a known method and containing 7.4 weight percent of methoxy groups linked to silicone. 63.9 g of trimethylolpropane, 14.8 g of ethylene glycol, 0.2 g of butyl titanate, 1000 g of xylene and 1000 g of the alkoxypolysiloxane are added to a distillation flask and heated with stirring. The reaction commences at 125° C. and the methanol formed is distilled off as a mixture with xylene. The temperature rises further to 140° C. The reaction time is one hour. When the desired viscosity of the reaction mixture has been reached, the reaction is terminated by cooling and diluting the reaction product with xylene to a 50% solids content. The reaction conversion, calculated on the basis of the methanol distilled off, is 38%. The final product has a viscosity of 4.6 $cm^2$/sec at 25° C.

Resin B

A polysiloxane is prepared from 526 parts by weight of methyltrichlorosilane, 436 parts by weight of phenyltrichlorosilane and 38 parts by weight of dimethyldichlorosilane according to the process described in U.S. Pat. No. 3,925,276 and is diluted with xylene to a solids content of 50%. Iron octoate (0.8 parts by weight) is added to 100 parts by weight of resin.

Resin C

A polysiloxane, prepared from 414 parts by weight of methyltrichlorosilane and 586 parts by weight of phenyltrichlorosilane according to the process described in U.S. Pat. No. 3,925,276, is diluted with xylene to 50% solids. To 100 parts by weight of resin, 0.8 parts by weight of iron octoate are added.

Resin D

An alkoxypolysiloxane (1000 g) which was prepared by cohydrolysis according to a known procedure from 35 mole percent of methyltrichlorosilane, 5 mole percent of dimethyldichlorosilane and 60 mole percent of phenyltrichlorosilane and which has 10 weight percent of ethyoxy groups linked to silicon, 99 g of trimethylolpropane, 0.2 g of butyl titanate and 1000 g of xylene are added to a distillation flask and heated with stirring. The reaction commences at 125° C. and the ethanol formed is distilled off in a mixture with xylene. The temperature rises further to 140° C. The reaction time is one hour. When the desired viscosity of the reaction mixture has been reached, the reaction is terminated by cooling and by diluting the reaction product with xylene to 50% solids. The reaction conversion, calculated from the amount of ethanol distilled off, is 46%. The final product has a viscosity of 8.9 $cm^2$/sec at 25° C.

PRODUCTION AND USE OF THE INVENTIVE PREPARATION

EXAMPLE 1

Siloxane resin A (100 parts by weight) is mixed with 0.4 parts by weight of

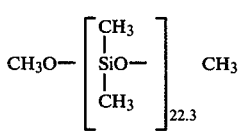

and, under stirring, treated with 0.5 parts by weight of butyl titanate catalyst. The reaction mixture is applied with a wire wiper onto sheet aluminum pretreated with Bonder 1400 Al and cured for 10 minutes at 270° C. The cured coating has a thickness of ca. 30 micron.

EXAMPLE 2

Siloxane resin A (100 parts by weight) is stirred for 5 minutes at 120° C. with 3 parts by weight of

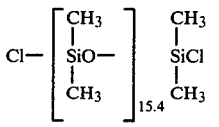

and then neutralized with sodium bicarbonate and finally filtered. The reaction is then cured in the manner described in Example 1.

EXAMPLE 3

The preparation of Example 2 (100 parts by weight) is pigmented with titanium dioxide (weight ratio of vehicle to titanium dioxide = 1:0.33). Subsequently, 0.4 parts by weight of ethyl cellulose are added and the product is cured as described in Example 1.

EXAMPLE 4

Siloxane resin A (100 parts by weight) is stirred with 0.15 parts by weight of

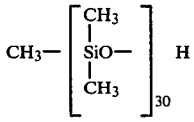

and 0.5 parts by weight butyl titanate catalyst. The product is then cured as described in Example 1.

EXAMPLE 5

Siloxane resin A (100 parts by weight) is mixed with 0.05 parts by weight of

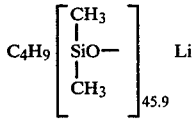

and cured in the manner described in Example 1.

EXAMPLE 6

Siloxane resin C (100 parts by weight) is mixed with 0.3 parts by weight of

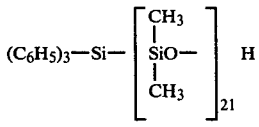

and cured in the manner described in Example 1.

EXAMPLE 7

Siloxane resin B (100 parts by weight) and 0.2 parts by weight of

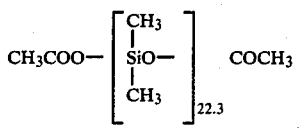

are mixed and cured in the manner described in Example 1.

EXAMPLE 8

Siloxane resin D (100 parts by weight) and 0.15 parts by weight of

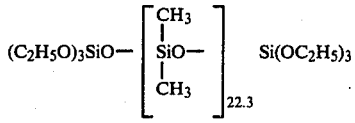

are mixed and cured in the manner described in Example 1.

EXAMPLE 9

(Comparison Example, not in accordance with the Invention)

Siloxane resin B (100 parts by weight) is mixed with 2.5 parts by weight of silicone oil 81 950 (of the General Electric Company) and cured as described in Example 1.

Application Tests of the Inventive Preparation and of the Comparison Preparation which is not in Accordance with the Invention Round cookies with a diameter of about 5 to 6 cm, prepared from a nutcake cake mix, were baked in a hot air oven for 12–15 minutes at 180° C. The cookies were cooled to 30° to 40° C. and pushed sideways from the baking tins.

The assessment is made by determining the weight percent of amounts adhering.

very good—no residue,
good—up to 10% residue,
satisfactory—residue between 10% and 30%,
unsatisfactory—more than 30% of residue.

The baking process is repeated ten times on the same baking tin. After each baking process, the baking tins are rinsed in a 2% detergent solution at 40° C. and washed well with water.

The test results are compiled in the following table:

| Example | Siloxane Resin | Baking Processes 1 | 5 | 10 |
|---|---|---|---|---|
| 1 | A | very good | very good | very good |
| 2 | A | very good | very good | very good |
| 3 | A | very good | very good | very good |
| 4 | A | very good | very good | very good |
| 5 | A | very good | very good | very good |
| 6 | C | very good | good | good |
| 7 | B | very good | very good | good |
| 8 | D | very good | very good | very good |
| 9 | | very good | satisfactory | unsatisfactory |

What is claimed is:

1. A composition for the abhesive coating of metallic cooking surfaces comprising a heat-curable polysiloxane resin, and based on the resin, 0.05 to 4 weight percent of a polysiloxane compound having the formula

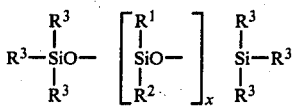

in which $R^1$ and $R^2$ are the same or different and represent a methyl or phenyl residue, with the proviso that at least 80 mole percent of these residues are methyl residues, $R^3$ are the same or different and represent a residue or several residues of the group (a) alkyl residues with 1 to 4 carbon atoms,
(b) phenyl residues,
(c) residues which are capable of reaction with the condensable groups of the curable polysiloxane resin, wherein at least one residue $R^3$ has the meaning of (c), X is 0 or a number greater than 0;

said resin having a reactive group which is capable of reacting with the reactive groups of the polysiloxane compound.

2. The composition of claim 1 wherein at least one $R^3$ is Cl, OH, LiO or $R^4O$, in which $R^4$ represents an alkyl or acyl residue with 1 to 4 carbon atoms.

3. The composition of claim 1 wherein the heat-curable siloxane resin is obtained by reacting siloxanes having the formula

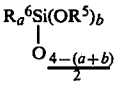

in which $OR^5$ is an alkoxy group of primary or secondary aliphatic alcohols with 1 to 4 carbon atoms, $R^6$ is an alkyl or phenyl residue, a is 1.0 to 1.5, b is 0.1 to 0.7, with low molecular weight, multivalent alcohols at temperatures of 100° C. to 160° C., in a ratio such that one $SiOR^5$ corresponds approximately to one COH group, and terminating the reaction at a degree of conversion of 25 to 85% by cooling to a temperature less than 100° C.

4. The composition of claim 3 wherein the low molecular weight multivalent alcohol is trimethylolpropane.

5. The composition of claim 3 or 4 wherein the $R^6$ residue is formed from methyl and phenyl residues and the molar ratio of methyl to phenyl residues is 0.5:1 to 4:1.

6. The composition of claim 1 which further contains hardeners, pigments, fillers, cross-linking agents, flow-promoting agents or solvents.

7. The composition of claim 3 wherein the reaction is carried out in the presence of a transesterification catalyst or solvent.

8. The composition of claim 2 wherein $R^4$ is methyl, ethyl, or acetyl.

9. The composition of claim 1 wherein at least 80 mole percent of the residues $R^1$ and $R^2$ are methyl.

10. The composition of claim 1 which contains at least two $R^3$-groups with the meaning of (c).

11. The composition of claim 9 wherein the remaining residues of the chain-limiting Si-atoms are alkyl residues having from 1 to 4 carbon atoms, phenyl residues, or combinations thereof.

12. The composition of claim 1 wherein x is from 10 to 500.

13. The composition of claim 1 wherein x is from 15 to 150.

14. The composition of claim 1 wherein the compound is

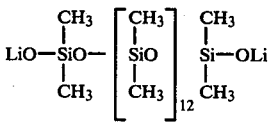

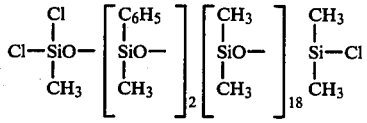

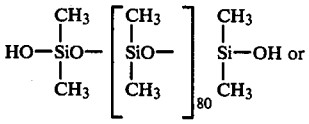

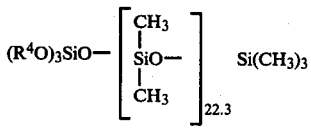

wherein $R^4 = C_2H_5$—.

15. The composition of claim 3 wherein $R^6$ residue is formed from methyl and phenyl residues and the molar ratio of methyl to phenyl residues is 2:1 to 3.5:1.

16. A method for preparing an abhesive coating composition for metallic cooking surfaces comprising reacting siloxanes having the formula

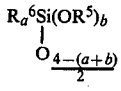

in which $OR^5$ is a alkoxy group of primary or secondary aliphatic alcohols with 1 to 4 carbon atoms, $R^6$ is an alkyl or phenyl residue, a is 1.0 to 1.5, b is 0.1 to 0.7, with low molecular weight, multivalent alcohols at temperatures of 100° C. to 160° C. in a ratio such that one $SiOR^5$ corresponds approximately to one COH group and terminating the reaction at a degree of conversion of 25 to 85% by cooling to a temperature less than 100° C., and dissolving the resulting product in a solvent containing the polysiloxane compound of claim 1 in an amount of from 0.05 to 4 weight percent based on the amount of said added product.

17. An article for cooking having a metal surface with a coating thereon of the cured abhesive coating of claim 1.

18. The article of claim 17 wherein the abhesive coating has a thickness from 10 to 40 microns.

19. A method for preparing an article having a metallic surface with an abhesive coating thereon comprising applying the composition of claim 1 to said metallic surface and then heating the surface at a temperature of 300° C. or less.

* * * * *